US007392111B2

(12) United States Patent
Shendege

(10) Patent No.: US 7,392,111 B2
(45) Date of Patent: Jun. 24, 2008

(54) ROTARY DESICCANT FEEDER METHOD AND APPARATUS

(75) Inventor: Devendra Win Shendege, Birdsboro, PA (US)

(73) Assignee: Omega Design Corporation, Exton, PA (US)

( * ) Notice: Subject to any disclaimer, the term of this patent is extended or adjusted under 35 U.S.C. 154(b) by 358 days.

(21) Appl. No.: 11/208,152

(22) Filed: Aug. 19, 2005

(65) Prior Publication Data

US 2006/0052899 A1 Mar. 9, 2006

Related U.S. Application Data

(60) Provisional application No. 60/605,247, filed on Aug. 27, 2004.

(51) Int. Cl.
*G06F 17/00* (2006.01)
*B65H 7/00* (2006.01)

(52) U.S. Cl. ..... 700/240; 700/231; 700/220; 221/17; 221/263; 221/264; 221/265

(58) Field of Classification Search ..... 221/265, 221/263, 264, 17, 217; 206/204; 53/249, 53/115, 527, 415, 135.1, 472, 139.5, 474; 700/231, 220

See application file for complete search history.

(56) References Cited

U.S. PATENT DOCUMENTS

| | | | | |
|---|---|---|---|---|
| 1,350,405 | A * | 8/1920 | Gaynor | 221/263 |
| 2,772,811 | A * | 12/1956 | Schaef | 221/263 |
| 3,417,542 | A * | 12/1968 | Merrill et al. | 221/265 |
| 6,382,880 | B2 * | 5/2002 | Rassman et al. | 406/194 |
| 6,598,368 | B1 * | 7/2003 | Haida | 53/115 |
| 6,799,413 | B2 * | 10/2004 | Aylward | 221/266 |

* cited by examiner

*Primary Examiner*—Gene O. Crawford
*Assistant Examiner*—Timothy R Waggoner
(74) *Attorney, Agent, or Firm*—Eugene E. Renz, Jr., P.C.

(57) ABSTRACT

A method and apparatus for efficient dispensing of desiccant canisters into containers is disclosed. The apparatus includes a microprocessor that monitors a plurality of sensors, and applies control signals to a servomotor that controls a rotary disc that transports desiccant canisters from a drop chute to containers. The containers pass through the apparatus via a conveyor system. Control signals determine the position and presence of desiccant canisters and containers to ensure proper operation. Error detection and recovery features are provided to handle the case of a missing desiccant canister, and halt the apparatus upon detection of an unrecoverable error.

9 Claims, 8 Drawing Sheets

ROTARY DESICCANT FEEDER METHOD AND APPARATUS

This Regular Patent Application claims the benefit of Provisional Patent Application No.: 60/605,247 filed Aug. 27, 2004 entitled: ROTARY DESICCANT FEEDER METHOD AND APPARATUS.

FIELD OF THE INVENTION

The present invention relates packaging equipment systems. More specifically the present invention relates to a method and apparatus for automating the delivery of desiccant canisters into a container.

BACKGROUND

Desiccants are often included in a packaged product to reduce moisture within the packaging. In particular, for pharmaceutical, food, chemical, and personal healthcare products, there is often a need for a desiccant to be placed in the container along with the product. To facilitate mass production, it is desirable to provide an efficient means for dispensing desiccant canisters into the product containers.

SUMMARY OF THE INVENTION

The present invention provides an improved method and apparatus for automating the delivery of desiccant canisters into a container. The apparatus of the present invention has a microprocessor that receives input signals from various sensors that provide information about the presence and position of desiccant canisters and containers. The microprocessor utilizes the information provided by these sensors to determine the appropriate control parameters for the motor and air flow that serve to move the desiccant through a predetermined path to the container.

It is an aspect of the present invention to provide a desiccant dispensing apparatus that can accommodate various different sized containers at a reduced cost. The apparatus of the present invention accomplishes this by eliminating the star-wheel commonly found on desiccant dispensing machines. Typically a separate star-wheel and corresponding dispenser disc would be required for each configuration. By eliminating the star-wheel, the cost for accommodating multiple configurations is dramatically reduced.

It is another aspect of the present invention to provide a desiccant dispensing apparatus with reduced changeover time. The present invention utilizes a dispenser disc that accommodates all container sizes. There is no star-wheel to change out, hence changeover time is reduced.

It is another aspect of the present invention to provide a desiccant dispensing apparatus that provides a more precise placement of desiccant within the container. This is accomplished in the present invention by bring the dispensing disc to a complete stop before dispensing the desiccant canister. Other dispensing apparatuses dispense desiccant while the dispensing disc is rotating. This causes the desiccant to be dispensed with an angular motion due to momentum and centrifugal force. With the apparatus of the present invention, the desiccant is dispensed into the container in vertical attitude.

It is another aspect of the present invention to provide increased throughput. The apparatus of the present invention includes a microprocessor based control system that allows desiccant to be dispensed at a higher rate than continuously rotating dispensing devices, which operate in the general range of 1 to 50 rpm typically. The dispensing apparatus of the present invention has an operating range of approximately 2000 rpm, which is considerably faster.

The desiccant dispensing apparatus of the present invention will be referred to as a Canister Desiccant Feeder Rotary (CDFR) for the purposes of this disclosure.

The aforementioned aspects, and other advantages of the CDFR will be explained in detail in the following sections.

DETAILED DESCRIPTION OF PREFERRED EMBODIMENTS

Figure 13:
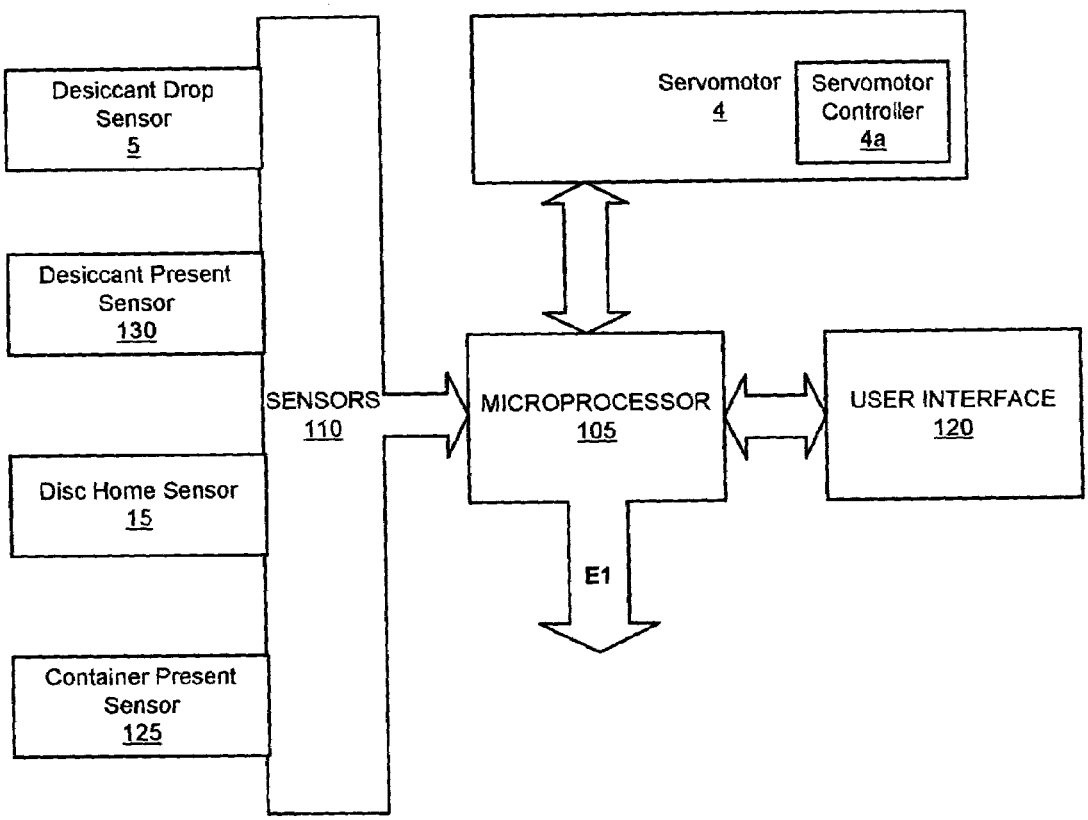
FIG. 13 is a system block diagram of the dispensing apparatus of the present invention.

Referring to FIG. 13, microprocessor 105 is configured to receive input from a plurality of sensors 110 provide information about the presence and position of desiccant canisters and containers. The sensors include a container present sensor 125, desiccant present sensor 130, desiccant drop sensor 5, and a dispenser disc home sensor 15. Microprocessor 105 is also in communication with a servomotor 4. The servomotor 4 includes an integrated servomotor controller **4*a*, which controls the servomotor that moves the transport mechanism that moves the desiccant canisters. Microprocessor 105 is also connected to a user interface 120** that allows the user to configure the apparatus for a particular job, and provides feedback, such as operating parameters and statistics, to the user.

The reader should now refer to FIGS. 1 through 12 for the following description. Canister desiccants are fed to the CDFR from a bowl sorting device that arranges the desiccant into a single column of desiccant canisters in a base up and base down attitude. The desiccant canisters are transferred to the CDFR via drop chute 18. Drop chute 18 is connected to CDFR dispenser housing 1 via chute adapter flange 16. A rotary disc 12 in the CDFR has a plurality of vacant areas with rotary disc 12, referred to as pocket holes, generally referenced as **12*a*. These pocket holes 12*a* are used to transport desiccant canisters from the chute adapter flange 16, to a container 30. As the rotary disc 12 rotates, pocket holes 12***a* are passed through three key positions (See FIG. 11): Transfer station (St) is the position where the desiccant canister is transferred from the drop chute 18 to the rotary disc 12. Sensing station (Ss) is where the presence of a desiccant canister is verified. Discharge station (Sd) is where the desiccant canister is released into a waiting container 30 (See FIG. 9). While the embodiment shown uses a separate transfer station (St) and sensing station (Ss), it is possible to combine the transfer station (St) and sensing station (Ss) into a single position. The flow of the desiccant canister through these key positions will now be described.

Figure 11:
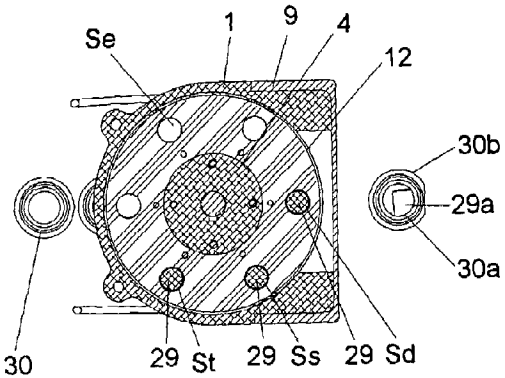
FIG. 11 is a transverse sectional view showing various stations including a transfer station (St), the desiccant sensing station (Ss), the discharge station (Sd) and the empty discharge station (Se).
Figure 9:
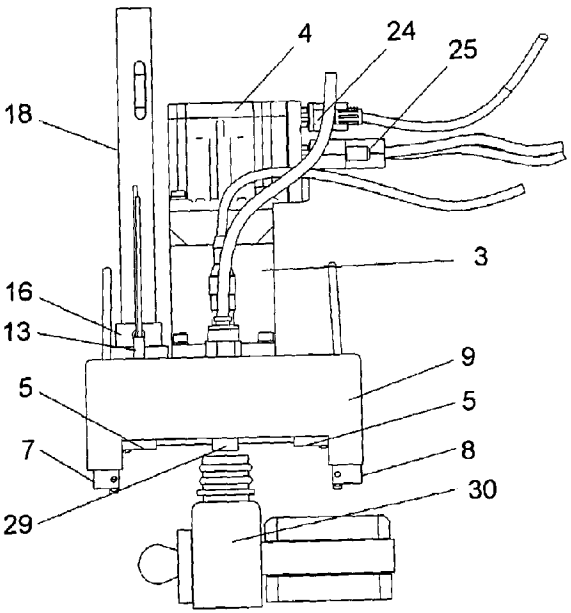
FIG. 9 is an end view showing containers aligned with the desiccant discharge station.
Figure 12:
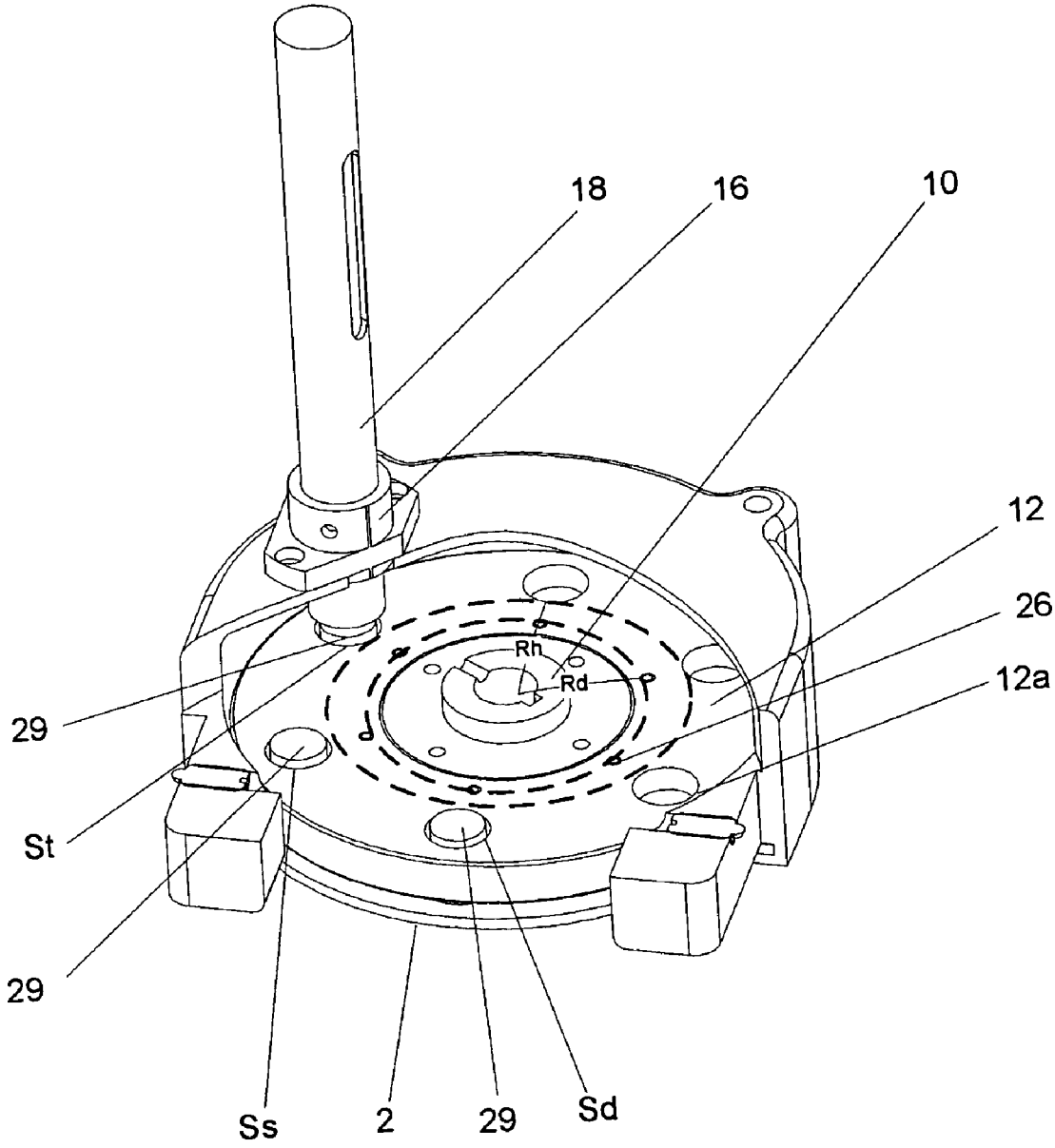
FIG. 12 is a perspective cutaway view showing various stations including a transfer station (St), the desiccant sensing station (Ss), and the discharge station (Sd).

The desiccant canister 29, upon traveling through drop chute 18, lands at transfer station (St) in a pocket hole of rotary disc 12 (see FIG. 11). The CDFR has an integrated servomotor 4 and servomotor controller 4*a*. For the purposes of this disclosure, the integrated servomotor and servomotor controller will be referred to simply as "servomotor". Servomotor 4 is attached to CDFR dispenser housing 1 and rotates the disc mounting hub 10 via planetary gearbox 3 to provide the rotary motion to the CDFR dispenser disc 12 (See FIG. 6). A CDFR dispenser housing nose 9 is removable to provide access to the CDFR for maintenance and servicing. Power and input/output (IO) lines are connected to servomotor 4 via a plurality of cables, indicated as items 24 and 25 in FIG. 6. The 10 signals are connected to microprocessor 105 via a wiring harness (not shown) to allow microprocessor 105 to monitor input from the sensors, and issue the appropriate commands to servomotor 4.

Servomotor 4 indexes rotary disc 12 to sensing station (Ss). At sensing station (Ss), desiccant present sensor 130 receives input from diffuse fiber optic cable 13 to verify the presence of a desiccant canister 29 in pocket hole 12*a* of rotary disc 12. A container present sensor 125, comprised of laser beam receiver 7 and laser beam emitter 8 (See FIG. 9) detect the presence of a container underneath discharge station (Sd). If a container is detected at discharge station (Sd), then rotary disc rotates to transport the desiccant canister 29 from sensing station (Ss) to discharge station (Sd) whereby the desiccant canister 29 drops by gravity into the container 30 at the discharge station (Sd). A desiccant drop sensor 5, preferably an optical sensor, verifies that the desiccant canister 29 successfully dispensed into container 30. The pocket hole 12*a* is now empty, and is able to receive another desiccant canister to be dispensed.

Typical configurations of rotary disc 12 would provide a pocket hole 12*a* arrangement conducive to the desiccant size in grams, based on the height and diameter of desiccant canister 29, and the maximum number of desiccant canisters to be dispensed into the container 30.

The number of desiccant pockets holes 12*a* in an arrangement is divided into 360 degrees of rotary disc 12 at equal angles around the center point, i.e. Example configurations include 6 pocket holes at 60 degree increments, and 4 holes at 90 degree increments. Other configurations are possible without departing from the scope of the present invention.

The pocket holes 12*a* are arranged on rotary disc 12 at predetermined radius Rh. For each pocket hole 12*a*, a corresponding dowel pin 26 is pressed in to rotary disc 12 along the centerline between center of pocket hole 12*a*, and center of rotary disc 12 at radius Rd (See FIG. 12). Dowel pins 26 are utilized provide feedback of the pocket hole 12*a* location to the servomotor 4.

Figure 2:
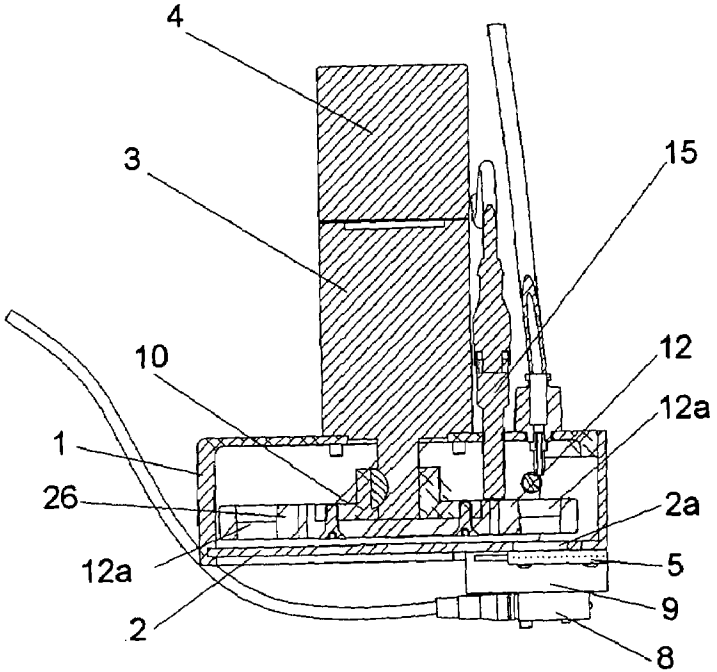
FIG. 2 is a transverse sectional view showing internal parts for the rotary desiccant feeder.
Figure 1:
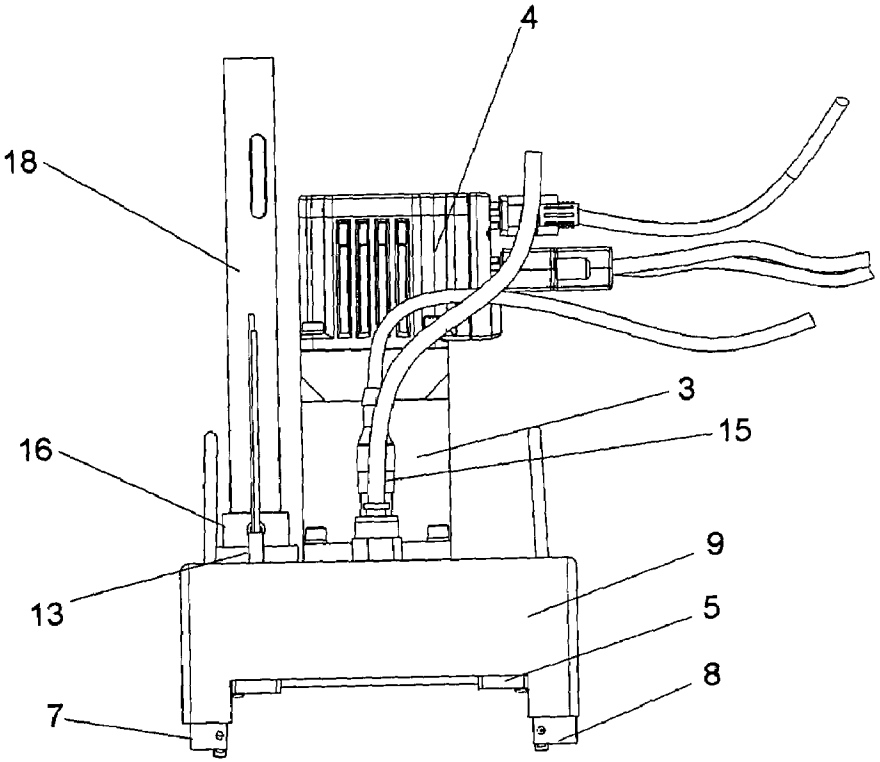
FIG. 1 is a side view of a rotary desiccant feeder method and apparatus of the present invention.

The servomotor 4, via its integrated motor controller, provides an encoder pulse count for positioning the desiccant pocket holes 12*a* within the rotary disc 12 to align with the CDFR dispenser housing cover 2 and the discharge hole 2*a* in the CDFR dispenser housing cover 2 (See FIG. 2). An incremental motion profile equal to the angle of the desiccant pocket holes 12*a* in the rotary disc 12 and the encoder pulse count ensure the motion for incremental move of the rotary disc 12 aligns to the discharge hole 2*a* in the CDFR dispenser housing cover 2. The servomotor 4 allows for the user to contour the profile of the rotary disc 12 motion for a given desiccant size and weight, container size and output rate. Program parameters of the servomotor 4 include the acceleration, deceleration and velocity of the rotary disc 12 to achieve a given output rate.

Figure 4:
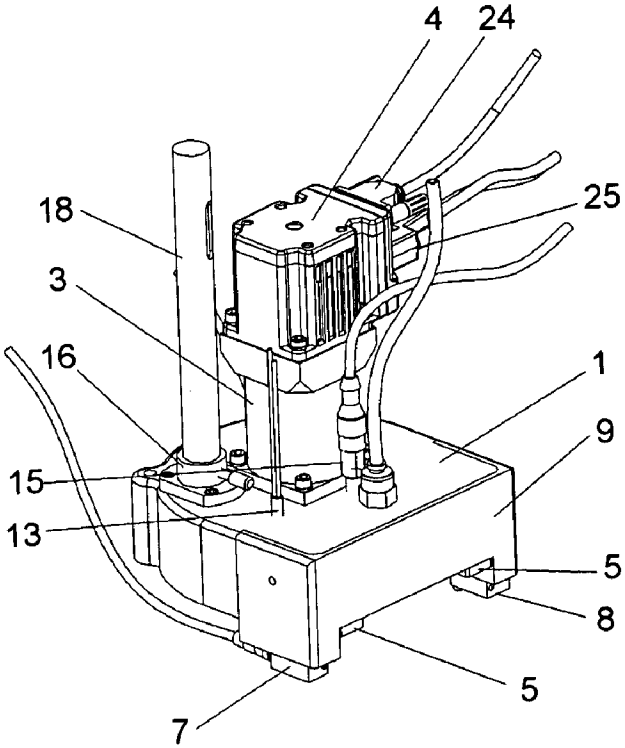
FIG. 4 is a perspective view of the rotary desiccant feeder.
Figure 3:
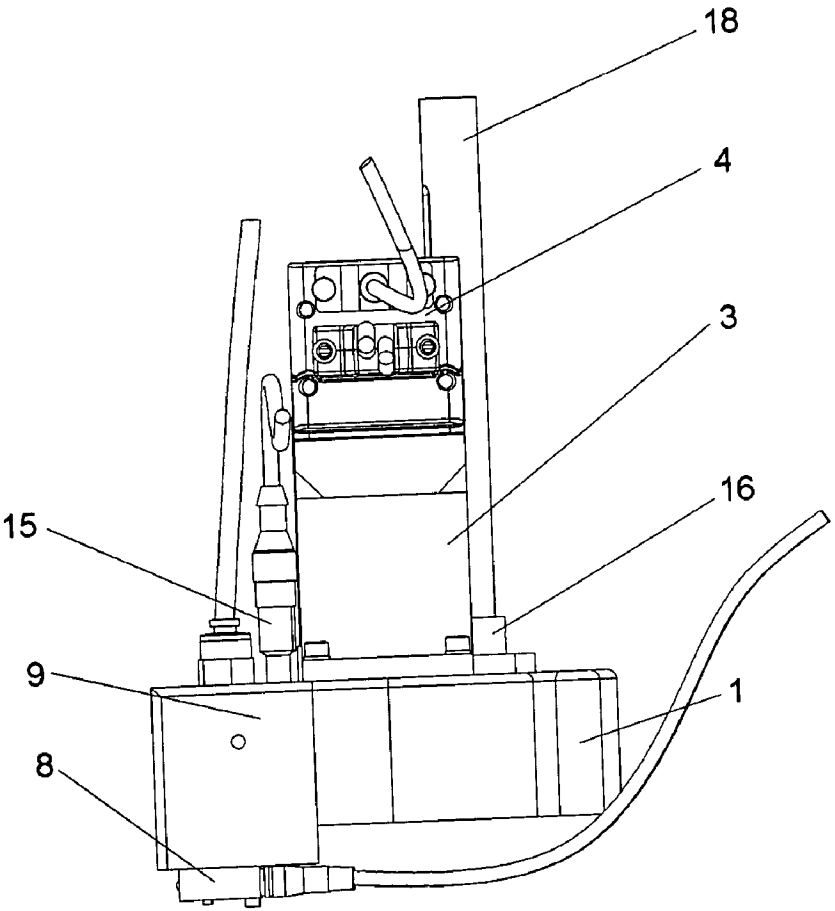
FIG. 3 is a front view of the rotary desiccant feeder.
Figure 6:
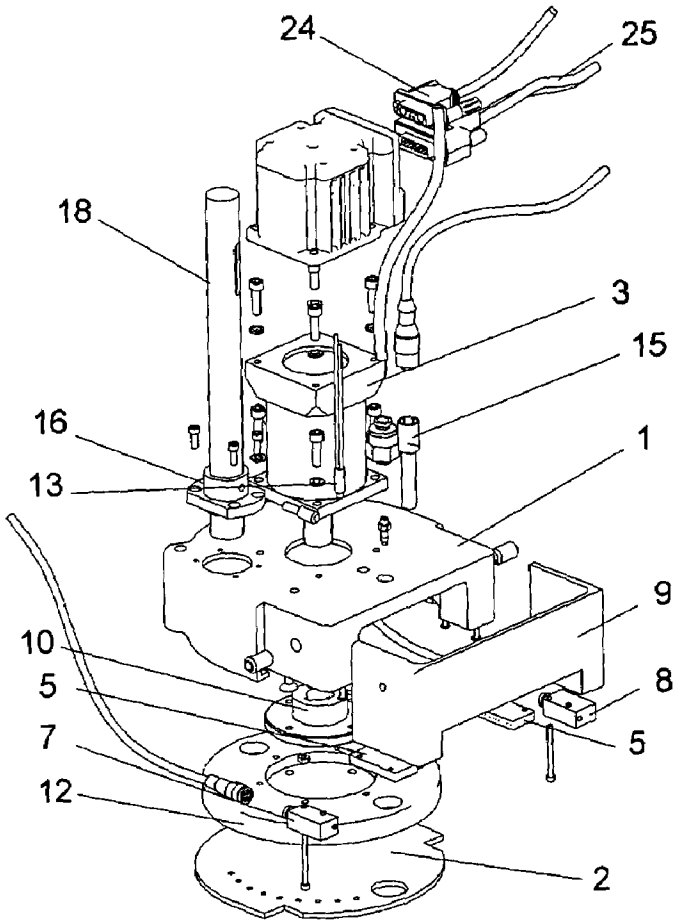
FIG. 6 is an exploded perspective view of the rotary desiccant feeder.
Figure 5:
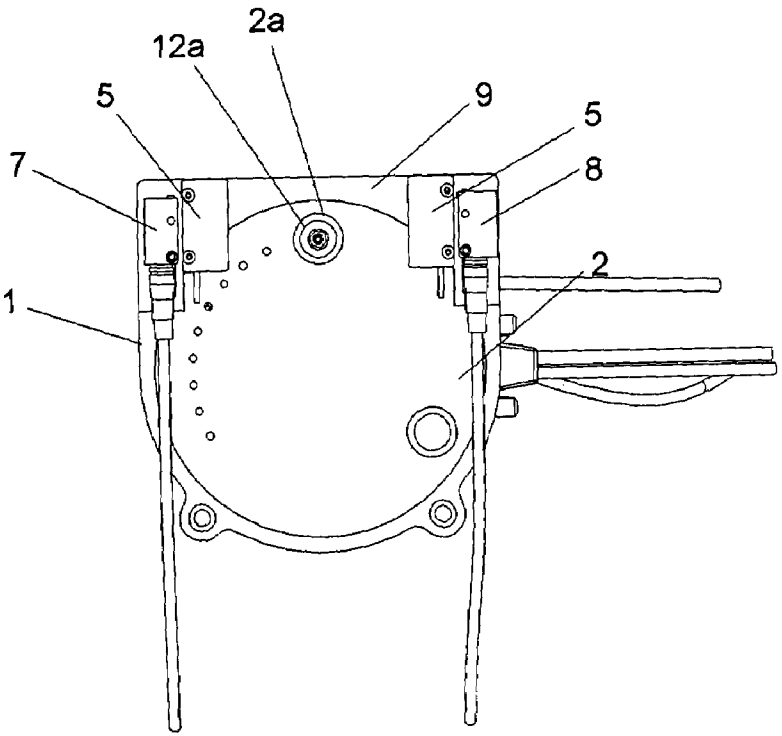
FIG. 5 is a top plan view of the rotary desiccant feeder.
Figure 7:
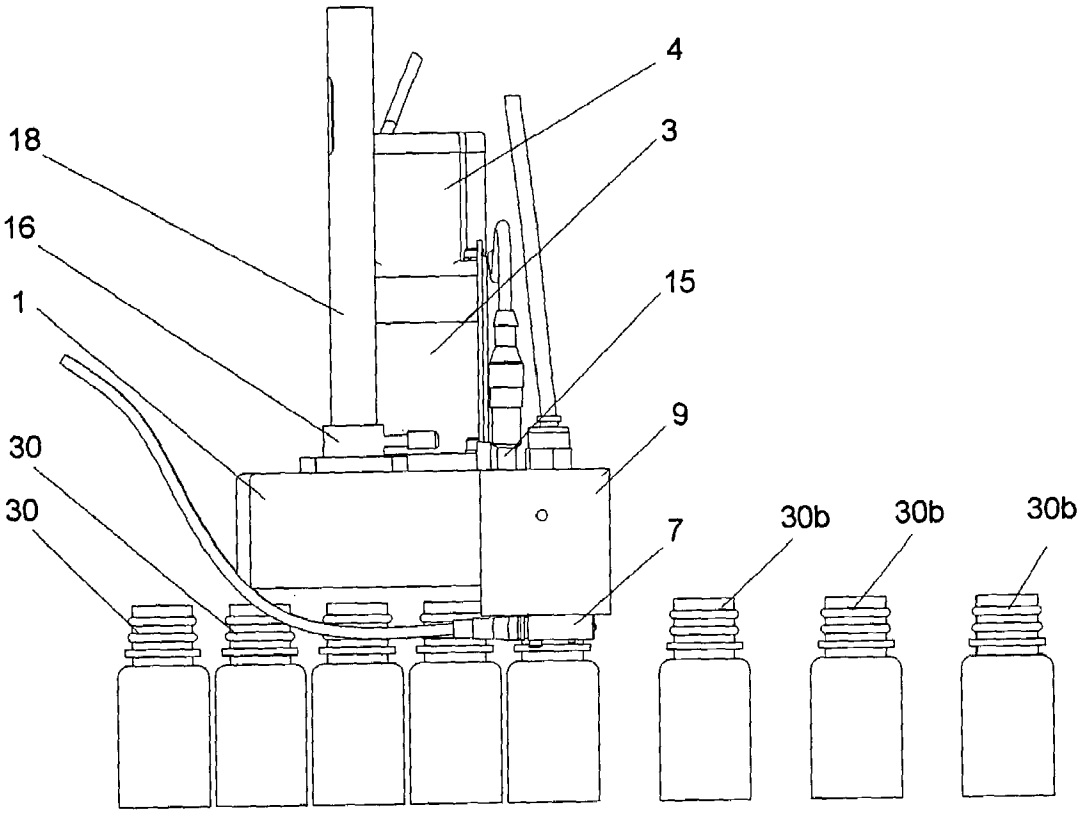
FIG. 7 is a side view of the desiccant dispensing apparatus and system showing containers passing through the desiccant loading station.

To index a pocket hole 12*a* to the next position, the servomotor 4 rotates rotary disc 12 until the next dowel pin 26 arrives at disc home sensor 15 (See FIGS. 4 and 6). In a preferred embodiment, disc home sensor 15 is an inductive proximity sensor that serves as a dowel sensor. Thus, by locating the position of the dowel 26, the corresponding pocket hole 12*a* is in a known position. Servomotor 4 rotates a predetermined number of degrees, based on the configuration of rotary disc 12. For example, if rotary disc 12 has 6 pocket holes 12*a*, then servomotor 4 will rotate 60 degrees. The fine positioning of the rotary disc will then be performed, based on feedback from disc home sensor 15.

Figure 8:
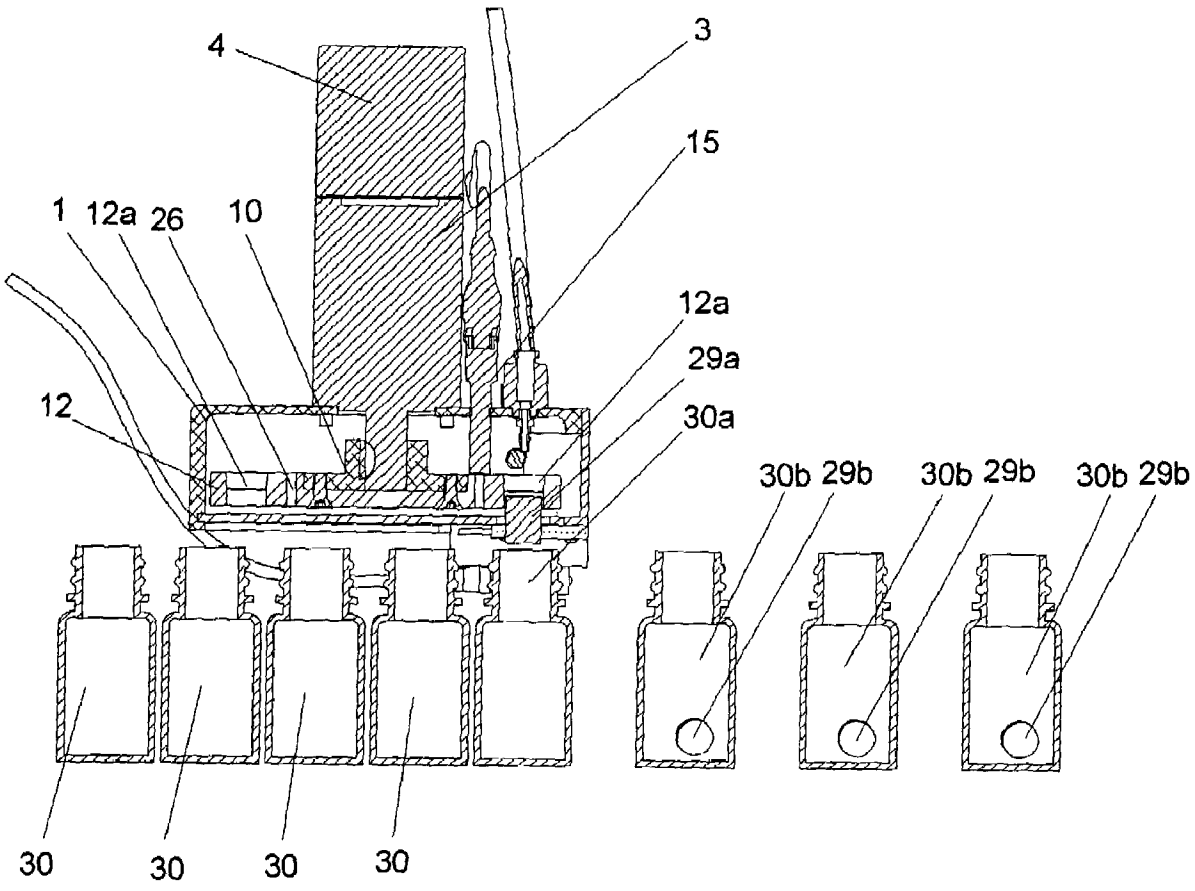
FIG. 8 is a transverse sectional view showing desiccant discharging into containers.
Figure 10:
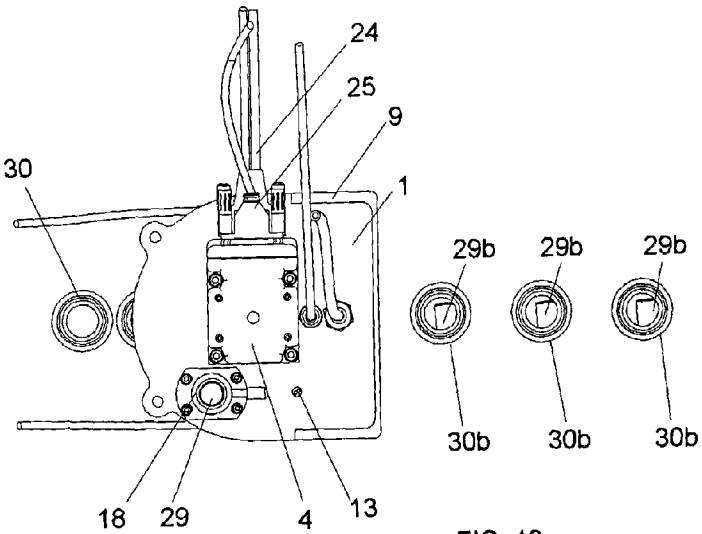
FIG. 10 is a top plan view showing empty containers before the discharge station and filled containers downstream of the desiccant feeder apparatus and system.

The CDFR provides error monitoring and recovery functions during its operation. During normal operation, containers are delivered to the desiccant feeder of the present invention by conventional conveyor systems and are aligned so that the open end of the containers is properly aligned and passes under the discharge station (Sd). Specifically, FIG. 8 shows a plurality of containers, indicated as reference 30, on a conveyor (not shown) that are to receive a desiccant canister from the CDFR. Container 30*a* is at discharge station (Sd). Desiccant canister 29*a* is about to be dispensed into container 30*a*. Containers indicated as 30*b* already have received a desiccant canister 29*b*.

If no desiccant canister 29 is sensed at the sensing station (Ss), an error signal E1 is generated (See FIG. 13). This signal can serve to stop or slow the conveyor. As an initial error recovery strategy, rotary disc 12 is rotated to place the next pocket hole 12*a* at the sensing station (Ss). If a desiccant canister 29 is now present, error signal E1 is cleared, and normal operation resumes. This allows operation to continue uninterrupted, even if a desiccant canister occasionally fails to arrive at transfer station (St) during a particular cycle. After a predetermined number of attempts, the CDFR is halted, as a more serious error is likely. Similarly, at discharge station (Sd), if desiccant drop sensor 5 does not detect a desiccant canister dispensing into container 30, error signal E1 is generated, and the CDFR is halted.

If a jam at the discharge station (Sd) prevents dispensing of desiccant canister 29, the rotary disc 12 rotates desiccant canister 29 beyond the discharge station (Sd) to the exit station (Se), whereby the desiccant canister can then exit the CDFR.

Accordingly, the reader will see that the present invention provides an efficient means for dispensing desiccant canisters into containers. Although the descriptions above contain many specific details, these should not be construed as limiting the scope of the invention, but merely as providing illustrations of some of the presently preferred embodiments of this invention. Thus, the scope of the invention should be determined by the appended claims and their legal equivalents, rather than by the examples given.

What is claimed is:

1. A method of dispensing a desiccant canister into a container, comprising the steps of:

a. positioning a disc such that a vacant area within said disc is located at a transfer station;

b. inserting a desiccant canister into said vacant area of said disc at said transfer station;

c. verifying the presence of said desiccant canister in said vacant area of said disc;

d. activating a conveyor signal to move a container into a dispensing station;

e. verifying presence of said container at said dispensing station;

f. rotating said disc, whereby said desiccant canister is located at said dispensing station directly above said container; and g. stopping said disc, whereby said desiccant canister drops into said container.

2. The method of claim 1, whereby the step of positioning said disc such that a vacant area with in said disc is located at a transfer station comprises the steps of:

a. rotating said disc a predetermined number of degrees;

b. detecting the position of a dowel mounted on said disc, said dowel being located on a radial line traveling through the centerline of said vacant area;

c. receiving input from a dowel sensor; and d. stopping rotation of said disc when input from said dowel sensor indicates that said dowel has arrived at a predetermined position.

3. An apparatus for dispensing a desiccant canister into a container, comprising:

a. a drop chute for inputting a desiccant canister into the apparatus;

b. a disc with a plurality of vacant areas for transporting said desiccant canister to a sensing station;

c. sensing means at said sensing station for indicating the presence of said desiccant canister within a vacant area of said disc;

d. a motor for moving said disc to transport said desiccant canister;

e. sensing means at a dispensing station to verify presence of a container at a dispensing station; and f. sensing means at a dispensing station to verify the dispensing of said desiccant canister into said container at said dispensing station.

4. The apparatus of claim 3, wherein said disc further comprises a dowel, located on a radial line, between the center of said disc, and center of each said vacant area.

5. The apparatus of claim 3, wherein said motor is a servomotor with an integrated servomotor controller.

6. The apparatus of claim 5, further comprising a planetary gearbox, whereby said servomotor rotates said disc via said planetary gearbox.

7. The apparatus of claim 4, wherein said sensing means at said sensing station for indicating the presence of said desiccant canister within a vacant area of said disc comprises an inductive proximity sensor, whereby said inductive proximity sensor generates a signal when said dowel is substantially close to said inductive proximity sensor.

8. The apparatus of claim 3, wherein said sensing means at a dispensing station to verify the dispensing of said desiccant canister into said container at said dispensing station comprises a laser beam emitter and a laser beam receiver, said laser beam emitter oriented opposite to said laser beam receiver, whereby a falling desiccant canister causes an interruption in a laser basin between said laser beam emitter and said laser beam receiver, said interruption providing an indication of a successfully dispensed desiccant canister.

9. A method for verifying successful dispensing of a desiccant canister into a container, comprising the steps of:

a. sensing a desiccant canister at a sensing station;

b. sensing a container at a discharge station;

c. sensing a desiccant canister dropping into said container at said discharge station; whereby an error signal is generated if at least one of said steps fails;

d. indexing to the next desiccant canister when said sensing a desiccant canister at said sensing station fails;

e. sensing said next desiccant canister at said sensing station; and f. halting the transport of desiccant canisters when a predetermined number of missing desiccant canister events have been detected.

* * * * *